United States Patent [19]

Harbulak

[11] 4,069,112

[45] Jan. 17, 1978

[54] ELECTROPLATING OF NICKEL, COBALT, MUTUAL ALLOYS THEREOF OR TERNARY ALLOYS THEREOF WITH IRON

[75] Inventor: Edward P. Harbulak, Allen Park, Mich.

[73] Assignee: M & T Chemicals Inc., Greenwich, Conn.

[21] Appl. No.: 729,074

[22] Filed: Oct. 4, 1976

Related U.S. Application Data

[63] Continuation-in-part of Ser. No. 697,490, June 18, 1976, abandoned.

[51] Int. Cl.[2] ..... C25D 3/12; C25D 3/56

[52] U.S. Cl. ..... 204/43 T; 204/48; 204/49

[58] Field of Search ..... 204/49, 48, 43 T, 112, 204/123; 106/1

[56] References Cited

U.S. PATENT DOCUMENTS

| | | | |
|---|---|---|---|
| 3,376,207 | 4/1968 | Ericson | 204/49 |
| 3,697,392 | 10/1972 | Duchene | 204/49 |

FOREIGN PATENT DOCUMENTS

| | | | |
|---|---|---|---|
| 205,781 | 6/1966 | Sweden | 204/49 |

*Primary Examiner*—G. L. Kaplan

*Attorney, Agent, or Firm*—Kenneth G. Wheeless; Robert Spector

[57] ABSTRACT

This invention relates to a process and composition for the preparation of an electro-deposit which contains; at least one metal selected from the group consisting of nickel and cobalt or; binary or ternary alloys of the metals selected from nickel, iron, and cobalt; which comprises passing current from an anode to a cathode through an aqueous acidic electroplating solution containing at least one member selected from nickel compounds and cobalt compounds and which may additionally contain iron compounds providing nickel, cobalt and iron ions for electrodepositing nickel, cobalt, nickel-cobalt alloys, nickel-iron alloys, cobalt-iron alloys or nickel-iron-cobalt alloys; the improvement comprising the presence of $5 \times 10^{-6}$ moles per liter to 0.5 mole per liter of an unsaturated cyclosulfone exhibiting the following generalized structural formula:

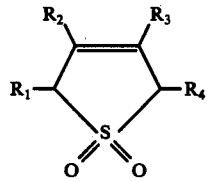

wherein $R_1$, $R_2$, $R_3$ and $R_4$ are independently hydrogen, lower alkyl, or hydroxyl;

for a time period sufficient to form a metal electroplate upon said cathode.

10 Claims, No Drawings

ELECTROPLATING OF NICKEL, COBALT, MUTUAL ALLOYS THEREOF OR TERNARY ALLOYS THEREOF WITH IRON

This application is a continuation in part of U.S. patent application Ser. No. 697,490 filed June 18, 1976, now abandoned.

BACKGROUND OF THE INVENTION

To conserve nickel and reduce costs, a number of procedures have been adopted by the nickel plating industry. Some of these procedures include reducing the thickness of nickel deposited, substituting cobalt for some or all of the nickel when cobalt is less expensive or more readily available, and more recently electrodepositing nickel-iron, cobalt-iron, or nickel-cobalt-iron alloys in which as much as 60% of the deposit may consist of relatively inexpensive iron. However, when deposit thickness is reduced, it is necessary to use more effective or "powerful" nickel brighteners or higher concentrations of nickel brighteners, so that the degree of brightening and leveling to which the nickel plating industry has grown accustomed may be obtained. The more "powerful" nickel brighteners or high concentrations of brighteners, while capable of producing the desired brightening and leveling, may nevertheless cause unacceptable side effects. The nickel deposits may peel or may be highly stressed, severely embrittled, less receptive to subsequent chromium deposits or exhibit hazes, reduced low current density covering power or "throw" or striations and skip plate, i.e., areas in which a deposit is not obtained.

Although in many respects, the electrodeposition of nickel-iron, cobalt-iron or nickel-cobalt-iron alloys is very similar to the electrodeposition of nickel in that similar equipment and operating conditions are employed; nevertheless, electroplating with iron containing alloys of nickel and/or cobalt presents some special problems. For example, one requirement in the electrodeposition of iron alloys of nickel and/or cobalt is that the iron in the electroplating solution should be predominantly in the ferrous state rather than the ferric. At a pH of about 3.5, basic ferric salts precipitate and can clog the anode bags and filters and may produce rough electrodeposits. It is, therefore, advantageous to prevent any ferric basic salts from precipitating. This can be accomplished by the addition of suitable complexing, chelating, anti-oxidant or reducing agents to the iron containing electroplating alloy bath as taught by Koretzky in U.S. Pat. No. 3,354,059; Passal in U.S. Pat. No. 3,804,726; or Clauss et al in U.S. Pat. No. 3,806,429. While these complexing or chelating agents are necessary in order to provide a solution to the ferric iron problem, their use may also result in several undesirable side effects. They can cause a reduction in deposit leveling and can also produce striated, hazy or dull deposits which may further exhibit step plate or even skip plate, i.e., areas which are not plated, or else plated only very thinly compared to other sections of the deposits.

In order to overcome the deleterious effects of high concentrations of brighteners or "powerful" brighteners, or to counteract the undesirable side effects of iron or iron solubilizing substances when these are present in nickel and/or cobalt, or iron containing nickel and/or cobalt electroplating baths, the addition of various sulfinic acids or their salts has been recommended by Brown in U.S. Pat. No. 2,654,703. Unfortunately, the sulfinic acids and their salts are unstable and subject to rapid oxidation by the oxygen of the atmosphere to the corresponding sulfonic acids or sulfonate salts, in which state they are no longer efficatious in overcoming the various side effects mentioned above. The use of sulfinic acids or their salts also severely reduces deposit leveling.

It is an object of this invention to provide processes and compositions for depositing electrodeposits of nickel, cobalt, or binary or ternary alloys of the metals selected from nickel, cobalt and iron which possess a greater tolerance for high concentrations of brighteners. It is a further object of this invention to provide deposits of nickel, cobalt or binary or ternary alloys of the metals selected from nickel, cobalt and iron characterized by increased ductility, brightness, covering power, and leveling or scratch hiding ability. If is a further object of this invention to overcome the problems caused by the presence of iron or iron solubilizing materials in iron alloy electroplating baths of nickel and/or cobalt. Other objects of this invention will be apparent from the following detailed description of this invention.

DESCRIPTION OF THE INVENTION

In accordance with certain of its aspects, this invention relates to a process and composition for the preparation of an electrodeposit which contains; at least one metal selected from the group consisting of nickel and cobalt or; binary or ternary alloys of the metals selected from nickel, iron, and cobalt; which comprises passing current from an anode to a cathode through an aqueous acidic electroplating solution containing at least one member selected from nickel compounds and cobalt compounds and which may additionally contain iron compounds providing nickel, cobalt and iron ions for electrodepositing nickel, cobalt, nickel-cobalt alloys, nickel-iron alloys, cobalt-iron alloys or nickel-iron-cobalt alloys; the improvement comprising the presence of $5 \times 10^{-6}$ moles per liter to 0.5 mole per liter of an unsaturated cyclosulfone exhibiting the following generalized structural formula:

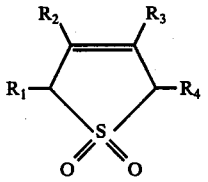

wherein $R_1$, $R_2$, $R_3$ and $R_4$ are independently hydrogen, lower alkyl, or hydroxyl;

for a time period sufficient to form a metal electroplate upon said cathode.

The baths of this invention may also contain an effective amount of at least one member selected from the group consisting of:

a. Class I brighteners b. Class II brighteners c. Anti-pitting or wetting agents The term "Class I brighteners" as used herein, and as described in *Modern Electroplating,* Third Edition, F. Lowenheim, Editor, is meant to include aromatic sulfonates, sulfonamides, sulfonimides, etc., as well as aliphatic or aromatic-aliphatic olefinically or acetylenically unsaturated sulfonates, sulfonamides, sulfonimides, etc. Specific examples of such plating additives are:

1. sodium o-sulfobenzimide
2. disodium 1,5-naphthalene disulfonate
3. trisodium 1,3,6-naphthalene trisulfonate
4. sodium benzene monosulfonate
5. dibenzene sulfonimide
6. sodium allyl sulfonate
7. sodium 3-chloro-2-butene-1sulfonate
8. sodium β-styrene sulfonate
9. sodium propargyl sulfonate
10. monoallyl sulfamide
11. diallyl sulfamide
12. allyl sulfonamide Such plating additive compounds, which may be used singly or in suitable combinations, are desirably employed in amounts ranging from about 0.5 to 10 grams per liter and provide the advantages described in the above reference and which are well known to those skilled in the art of nickel electroplating.

The term "Class II brighteners" as used herein, and as described in *Modern Electroplating*, Third Edition, F. Lowenheim, Editor, is meant to include plating additive compounds such as reaction products of epoxides with alphahydroxy acetylenic alcohols such as diethoxylated 2-butyne-1, 4-diol or dipropoxylated 2-butyne-1,4-diol, other acetylenics, N-heterocyclics, dye-stuffs, etc. Specific examples of such plating additives are:

1. 1,4-di-(β-hydroxyethoxy)-2-butyne
2. 1,4-di-(β-hydroxy-γ-chloropropoxy)-2-butyne
3. 1,4-di-(β-,γ-epoxypropoxy)-2-butyne
4. 1,4-di-(β-hydroxy-γ-butenoxy)-2-butyne
5. 1,4-di-(2'-hydroxy-4'-oxa-6'-heptenoxy)-2-butyne
6. N-(2,3-dichloro-2-propenyl)-pyridinium chloride
7. 2,4,6-trimethyl N-propargyl pyridinium bromide
8. N-allylquinaldinium bromide
9. 2-butyne-1,4-diol
10. propargyl alcohol
11. 2-methyl-3-butyn-2-ol
12. quinaldyl-N-propanesulfonic acid betaine
13. quinaldine dimethyl sulfate
14. N-allylpyridinium bromide
15. isoquinaldyl-N-propanesulfonic acid betaine
16. isoquinaldine dimethyl sulfate
17. N-allylisoquinaldine bromide
18. 1,4-di-(β-sulfoethoxy)-2-butyne
19. 3-(β-hydroxyethoxy)-propyne
20. 3-(β-hydroxypropoxy)-propyne
21. 3-(β-sulfoethoxy)-propyne
22. phenosafranin
23. fuchsin When used alone or in combination, desirably in amounts ranging from about 5 to 1000 milligrams per liter, a Class II brightener may produce no visual effect on the electrodeposit, or may produce semi-lustrous, fine-grained deposits. However, best results are obtained when Class II brighteners are used with one or more Class I brighteners in order to provide optimum deposit luster, rate of brightening, leveling, bright plate current density range, low current density coverage, etc.

The term "anti-pitting or wetting agents" as used herein is meant to include a material which functions to prevent or minimize gas pitting. An anti-pitting agent, when used alone or in combination, desirably in amounts ranging from about 0.05 to 1 gram per liter, may also function to make the baths more compatible with contaminants such as oil, grease, etc. by their emulsifying, dispersing, solubilizing, etc. action on such contaminants and thereby promote attaining of sounder deposits. Preferred anti-pitting agents may include sodium lauryl sulfate, sodium lauryl ethersulfate and sodium di-alkylsulfosuccinates.

The nickel compounds, cobalt compounds and iron compounds employed to provide nickel, cobalt and iron ions for electrodepositing nickel, cobalt, or binary or ternary alloys of nickel, cobalt and iron, (such as nickel-cobalt, nickel-iron, cobalt-iron and nickel-cobalt-iron alloys) are typically added as the sulfate, chloride, sulfamate or fluoborate salts. The sulfate, chloride, sulfamate or fluoborate salts of nickel or cobalt are employed in concentrations sufficient to provide nickel and/or cobalt ions in the electroplating solutions of this invention in concentrations ranging from about 10 to 150 grams per liter. The iron compounds, such as the sulfate, chloride, etc. when added to the nickel, cobalt, or nickel and cobalt containing electroplating solutions of this invention, are employed in concentrations sufficient to provide iron ions ranging in concentration from about 0.25 to 25 grams per liter. The ratio of nickel ions or cobalt ions or nickel and cobalt ions to irons ions may range from about 50 to 1 to about 5 to 1.

The iron ions in the electroplating solutions of this invention may also be introduced through the use of iron anodes, rather than through the addition of iron compounds. Thus, for example, if some percentage of the total anode area in a nickel electroplating bath is composed of iron anodes, after some period of electrolysis enough iron will have been introduced into the bath by chemical or electrochemical dissolution of the iron anodes to provide the desired concentration of iron ions.

The nickel, cobalt, nickel-cobalt, nickel-iron, cobalt-iron and nickel-cobalt-iron electroplating baths of this invention additionally may contain from about 30 to 60 grams per liter, preferably about 45 grams per liter of boric acid or other buffering agents to control the pH (e.g. from about 2.5 to 5, preferably about 3 to 4) and to prevent high current density burning.

When iron ions are present in the plating baths of this invention, the inclusion of one or more iron complexing, chelating, anti-oxidizing, reducing, or other iron solubilizing agents such as citric, malic, glutaric, gluconic, ascorbic, isoascorbic, muconic, glutamic, glycollic, and aspartic acids or similar acids or their salts are desirable in the iron containing baths to solubilize iron ions. These iron complexing or solubilizing agents may range in concentration in the plating solution from about one gram per liter to about 100 grams per liter, depending on how much iron is present in the plating bath.

In order to prevent "burning" of high current density areas, provide for more even temperature control of the solution, and control the amount of iron in the iron containing alloy deposits, solution agitation may be employed. Air agitation, mechanical stirring, pumping, cathode rod and other means of solution agitation are all satisfactory. Additionally, the baths may be operated without agitation.

The operating temperature of the electroplating baths of this invention may range from about 40° to about 85° C, preferably from about 50° to 70°.

The average cathode current density may range from about 0.5 to 12 amperes per square decimeter, with 3 to 6 amperes per square decimeter providing an optimum range.

Typical aqeous nickel-containing electroplating baths (which may be used in combination with effective amounts of cooperating additives) include the following wherein all concentrations are in grams per liter (g/l) unless otherwise indicated:

TABLE I

AQUEOUS NICKEL-CONTAINING ELECTROPLATING BATHS

| | Minimum | Maximum | Preferred |
|---|---|---|---|
| Component: | | | |
| $NiSO_4 \cdot 6H_2O$ | 75 | 500 | 300 |
| $NiCl_2 \cdot 6H_2O$ | 20 | 100 | 60 |
| $H_3BO_3$ | 30 | 60 | 45 |
| pH (electrometric) | 3 | 5 | 4 |

When ferrous sulfate ($FeSO_4.7H_2O$) is included in the foregoing bath the concentration is about 2.5 grams per liter to about 125 grams per liter.

Typical sulfamate-type nickel plating baths which may be used in the practice of this invention may include the following components:

TABLE II

AQUEOUS NICKEL SULFAMATE ELECTROPLATING BATHS

| | Minimum | Maximum | Preferred |
|---|---|---|---|
| Component: | | | |
| Nickel Sulfamate | 100 | 500 | 375 |
| $NiCl_2 \cdot 6H_2O$ | 10 | 100 | 60 |
| $H_3BO_3$ | 30 | 60 | 45 |
| pH (Electrometric) | 3 | 5 | 4 |

When ferrous sulfate ($FeSO_4.7H_2O$) is included in the foregoing bath the concentration is about 2.5 grams per liter to about 125 grams per liter.

Typical chloride-free sulfate-type nickel plating baths which may be used in the practice of this invention may include the following components:

TABLE III

AQUEOUS CHLORIDE-FREE NICKEL ELECTROPLATING BATHS

| | Minimum | Maximum | Preferred |
|---|---|---|---|
| Component: | | | |
| $NiSO_4 \cdot 6H_2O$ | 100 | 500 | 300 |
| $H_3BO_3$ | 30 | 60 | 45 |
| pH (Electrometric) | 2.5 | 4 | 3–3.5 |

When ferrous sulfate ($FeSO_4.7H_2O$) is included in the foregoing baths the concentration is about 2.5 grams per liter to about 125 grams per liter.

Typical chloride-free sulfamate-type nickel plating baths which may be used in the practice of this invention may include the following components:

TABLE IV

AQUEOUS CHLORIDE-FREE NICKEL SULFAMATE ELECTROPLATING BATHS

| | Minimum | Maximum | Preferred |
|---|---|---|---|
| Component: | | | |
| Nickel sulfamate | 200 | 500 | 350 |
| $H_3BO_3$ | 30 | 60 | 45 |
| pH (Electrometric) | 2.5 | 4 | 3–3.5 |

When ferrous sulfate ($FeSO_4.7H_2O$) is included in the foregoing baths the concentration is about 2.5 grams per liter to about 125 grams per liter.

The following are aqueous cobalt-containing and cobalt-nickel-containing electroplating baths which may be used in the practice of this invention:

TABLE V

AQUEOUS COBALT-CONTAINING AND COBALT-NICKEL-CONTAINING ELECTROPLATING BATHS (All concentrations in g/l unless otherwise noted)

| | Minimum | Maximum | Preferred |
|---|---|---|---|
| Cobalt bath | | | |
| $CoSO_4 \cdot 7H_2O$ | 50 | 500 | 300 |
| $CoCl_2 \cdot 6H_2O$ | 15 | 125 | 60 |
| $H_3BO_3$ | 30 | 60 | 45 |
| Cobalt bath | | | |
| $CoSO_4 \cdot 7H_2O$ | 100 | 500 | 400 |
| NaCl | 15 | 60 | 30 |
| $H_3BO_3$ | 30 | 60 | 45 |
| High chloride cobalt bath | | | |
| $CoSO_4 \cdot 7H_2O$ | 75 | 350 | 225 |
| $CoCl_2 \cdot 6H_2O$ | 50 | 350 | 225 |
| $H_3BO_3$ | 30 | 60 | 45 |
| Cobalt-nickel alloy bath | | | |
| $NiSO_4 \cdot 6H_2O$ | 75 | 400 | 300 |
| $CoSO_4 \cdot 7H_2O$ | 15 | 300 | 80 |
| $NiCl_2 \cdot 6H_2O$ | 15 | 75 | 60 |
| $H_3BO_3$ | 30 | 60 | 45 |
| All-chloride cobalt bath | | | |
| $CoCl_2 \cdot 6H_2O$ | 100 | 500 | 300 |
| $H_3BO_3$ | 30 | 60 | 45 |
| Sulfamate cobalt bath | | | |
| Cobalt sulfamate | 100 | 400 | 290 |
| $CoCl_2 \cdot 6H_2O$ | 15 | 76 | 60 |
| $H_3BO_3$ | 30 | 60 | 45 |

The pH in the typical formulations of Table V may range from about 3 to 5 with 4 preferred.

When ferrous sulfate ($FeSO_4.7H_2O$) is included in the foregoing baths the concentration is about 2.5 grams per liter to 125 grams per liter.

Typical nickel-iron containing electroplating baths which may be used in the practice of this invention may include the following components:

TABLE VI

AQUEOUS NICKEL-IRON ELECTROPLATING BATHS

| | Minimum | Maximum | Preferred |
|---|---|---|---|
| Component: | | | |
| $NiSO_4 \cdot 6H_2O$ | 20 | 500 | 200 |
| $NiCl_2 \cdot 6H_2O$ | 15 | 300 | 60 |
| $FeSO_4 \cdot 7H_2O$ | 1 | 125 | 40 |
| $H_3BO_3$ | 30 | 60 | 45 |
| pH (Electrometric) | 2.5 | 5 | 3.5–4 |

With the inclusion of ferrous sulfate ($FeSO_4.7H_2O$) in the foregoing bath formulations it is desirable to additionally include one or more iron complexing, chelating or solubilizing agents ranging in concentration from about 1 gram per liter to about 100 grams per liter, depending on the actual iron concentration.

It will be apparent that the above baths may contain compounds in amounts falling outside the preferred minimum and maximum set forth, but most satisfactory and economical operation may normally be effected when the compounds are present in the baths in the amounts indicated.

The pH of all of the foregoing illustrative aqueous nickel-containing, cobalt-containing, nickel-cobalt-containing, nickel-iron, cobalt-iron and nickel-cobalt-iron-containing compositions may be maintained during plating at pH values of 2.5 to 5.0, and preferably from about 3.0 to 4.0. During bath operation, the pH may normally tend to rise and may be adjusted with acids such as hydrochloric acid, sulfuric acid, etc.

Anodes used in the above baths may consist of the particular single metal being plated at the cathode such as nickel or cobalt for plating nickel or cobalt respectively. For plating binary or ternary alloys such as nickel-cobalt, cobalt-iron, nickel-iron or nickel-cobalt-iron, the anodes may consist of the separate metals involved suitably suspended in the bath as bars, strips or small chunks in titanium baskets. In such cases the ratio of the separate metal anode areas is adjusted to correspond to the particular cathode alloy composition desired. For plating binary or ternary alloys one may also use as anodes alloys of the metals involved in such a percent weight ratio of the separate metals as to correspond to the percent weight of the same metals in the cathode alloy deposits desired. These two types of anode systems will generally result in a fairly constant bath metal ion concentration for the respective metals. If with fixed metal ratio alloy anodes there does occur some bath ion imbalance, occasional adjustments may be made by adding the appropriate corrective concentration of the individual metal salts. All anodes are usually suitably covered with cloth or plastic bags of desired porosity to minimize introduction into the bath of metal particles, anode slime, etc. which may migrate to the cathode either mechanically or electrophoretically to give roughness in cathode deposits.

The substrates on which the nickel-containing, cobalt-containing, nickel-cobalt-containing, nickel-iron-containing, cobalt-iron-containing or nickel-cobalt-iron-containing electrodeposits of this invention may be applied may be metal or metal alloys such as are commonly electro-deposited and used in the art of electroplating such as nickel, cobalt, nickel-cobalt, copper, tin, brass, etc. Other typical substrate basis metals from which articles to be plated are manufactured may include ferrous metals such as iron, steel, alloy steels, copper, tin and alloys thereof such as with lead, alloys of copper such as brass, bronze, etc., zinc, particularly in the form of zinc-base die castings; all of which may bear plates of other metals, such as copper, etc. Basis metal substrates may have a variety of surface finishes depending on the final appearance desired, which in turn depends on such factors as luster, brilliance, leveling, thickness, etc. of the cobalt, nickel, or iron containing electroplate applied on such substrates.

While nickel, cobalt, nickel-cobalt, nickel-iron, cobalt-iron or nickel-iron-cobalt electrodeposits can be obtained employing the various parameters described above, the brightness, leveling, ductility and covering power may not be sufficient or satisfactory for a particular application. In addition, the deposits may be hazy or dull, and also exhibit striations, step plate, peeling or poor chromium receptivity. These conditions may especially result after the addition of excessive replenishment amounts of Class II brighteners, or from the use of especially "powerful" Class II brighteners. In the case of the iron-containing plating baths which additionally contain iron solubilizing agents, the iron or the iron solubilizing agents may also cause a loss of leveling and brightness, or may result in hazy, dull or striated deposits. I have discovered that the addition or inclusion of certain bath compatible unsaturated cyclosulfones when added to an aqueous acidic nickel, cobalt, nickel-cobalt, nickel-iron, cobalt-iron or nickel-iron-cobalt electroplating bath will correct the aforementioned deficiencies. Additionally, the unsaturated cyclosulfone compounds of this invention permit the use of higher than normal concentrations of Class II brighteners, thus permitting higher rates of brightening and leveling without the undesirable striations, skip plate, brittleness, etc. normally expected under these conditions.

These bath soluble unsaturated cyclosulfones are characterized by the following structural formula:

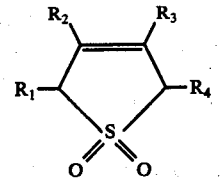

wherein $R_1$, $R_2$, $R_3$ and $R_4$ are independently hydrogen, lower alkyl, or hydroxyl. It is understood that bath compatible substituent groups such as chloride, bromide, alkoxy, etc., which in themselves do not contribute to the efficacy of the unsaturated cyclosulfones, but are either inert with respect to the electroplating solution, or may provide increased bath solubility to the parent sulfone, may also be present.

Typical or representative compounds which are characterized by the above generalized formula are listed but not limited to the following:

| | |
|---|---|
| 2,5-Dihydrothiophene-1,1-dioxide (Sulfolene) | 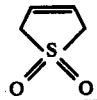 |
| 3-Methylsulfolene | 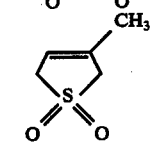 |
| 2,4-Dimethylsulfolene | 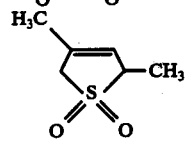 |
| 2-Hydroxysulfolene | 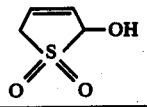 |

The unsaturated cyclosulfones of this invention are unusual in that they do not act as brighteners per se in the same way as brighteners of the first or second class and therefore should not be thought of as brighteners, but rather as addition agents whose function in the bath is to overcome haze, striation, peeling, step and skip plate. In addition, the low current density coverage and deposit leveling may be improved by the addition of these compounds to nickel, cobalt, nickel-cobalt, nickel-iron, cobalt-iron or nickel-cobalt-iron electroplating baths.

The unsaturated cyclosulfones of this invention are employed in the electroplating baths of this invention at concentrations of from about $5 \times 10^{-6}$ moles per liter to about 0.5 mole per liter and preferably from about $1 \times 10^{-5}$ moles per liter to 0.1 mole per liter.

The following examples are presented as an illustration to provide those skilled in the art of electroplating a better understanding of the various embodiments and aspects of this invention. These examples should not be construed as limiting the scope of the invention in any way.

EXAMPLE 1

An aqueous nickel electroplating bath was prepared having the following composition:

| | Composition in g/l |
|---|---|
| $NiSO_4 \cdot 6H_2O$ | 300 |
| $NiCl_2 \cdot 6H_2O$ | 60 |
| $H_3BO_3$ | 45 |
| Sodium o-sulfobenzimide | 3.6 |
| Sodium allyl sulfonate | 3.7 |
| 1,4-di(β-hydroxyethoxy)-2-butyne | 0.2 |
| pH | 3.8 |
| Temperature | 57° C |

A polished brass panel was scribed with a horizontal single pass of 4/0 grit emery polishing paper to give a band about 1 cm wide at a distance of about 2.5 cm from and parallel to the bottom edge of the panel. The cleaned panel was then plated in a 267 ml Hull Cell, using the above solution, for 10 minutes at 2 amperes cell current, using magnetic stirring. The resulting nickel deposit was brilliant but exhibited severe striations across the entire current density range of the test panel. Additionally, the deposit was thin and dark in the region from about zero to 1.2 amperes per square decimeter (ASD) and peeled in the region from about 1.5 ASD to the high current density edge of the test panel (about 12 ASD). The poor physical characteristics of the deposit (i.e., striations, dark areas, peeling) were due to the relative high concentration of Class II brightener.

On adding $4.1 \times 10^{-3}$ moles per liter (0.5 gram per liter) of tetrahydrothiophene-1,1-dioxide, (sulfolane)

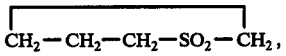

$$CH_2-CH_2-CH_2-SO_2-CH_2,$$

to the plating solution and repeating the plating test, the resulting nickel deposit was identical to that obtained initially. Increasing the sulfolane concentration to $4.1 \times 10^{-2}$ moles per liter (5 grams per liter) in the plating solution and repeating the test, likewise had no observable effect on the resulting nickel deposit.

EXAMPLE 2

An aqueous nickel electroplating bath was prepared and tested in the manner described in the first part of Example 1. The resulting nickel deposit suffered the same faults as previously mentioned.

On adding $3.4 \times 10^{-3}$ moles per liter (0.4 grams per liter) of 2,5-dihydrothiophene-1,1-dioxide, (sulfolene)

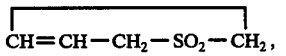

$$CH=CH-CH_2-SO_2-CH_2,$$

to the test solution and repeating the plating test, the resultant nickel deposit was uniformly brilliant across the entire current density range and was free of the striations, low current density darkness and peeling observed initially.

EXAMPLE 3

An aqueous nickel electroplating bath was prepared and tested in the manner described in the first part of Example 1 with the deposit exhibiting striations, peeling and low current density darkness as already noted.

On adding $7.6 \times 10^{-3}$ moles per liter (1.0 gram per liter) of 3-methyl-2,5-dihydrothiophene-1,1-dioxide, (3-methylsulfolene)

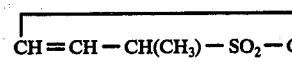

$$CH=CH-CH(CH_3)-SO_2-CH_2,$$

to the test solution and repeating the plating test, the resultant nickel deposit was brilliant across the entire current density range of the test panel, exhibited excellent leveling as indicated by the obliteration or filling in of the emery scratches and was free of striations and deposit peeling.

EXAMPLE 4

An aqueous nickel electroplating bath was prepared and tested in the manner described in the first part of Example 1. The resulting nickel deposit suffered the same faults as mentioned previously.

On adding $6.8 \times 10^{-3}$ moles per liter (1.0 gram per liter) of 2,4-dimethyl-2,5-dihydrothiophene-1,1-dioxide, (2,4-dimethyl-3-sulfolene)

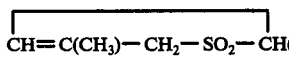

$$CH=C(CH_3)-CH_2-SO_2-CH(CH_3),$$

to the test solution and repeating the plating test, the resultant nickel deposit was brilliant over the entire current density range and the striations, deposit peeling the low current density darkness were significantly reduced or eliminated.

EXAMPLE 5

An aqueous nickel-iron electroplating bath was prepared having the following composition:

| | Composition in g/l |
|---|---|
| $NiSO_4 \cdot 6H_2O$ | 150 |
| $NiCl_2 \cdot 6H_2O$ | 90 |
| $FeSO_4 \cdot 7H_2O$ | 40 |
| $H_3BO_3$ | 49 |
| Iso-ascorbic acid | 2 |
| Sodium o-sulfobenzimide | 3.6 |
| Sodium allyl sulfonate | 3.5 |
| 1,4-di(β-hydroxyethozy)-2-butyne | 0.1 |
| pH | 3.2 |
| Temperature | 55° C |

A polished brass panel was scribed with a horizontal single pass of 4/0 grit emery polishing paper to give a band about 1 cm wide at a distance of about 2.5 cm from and parallel to the bottom edge of the panel. The cleaned panel was then plated in a 267 ml Hull Cell, using the above solution, for 10 minutes at 2 amperes cell current, using magnetic stirring. The resulting nickel-iron deposit was bright and well leveled from about 2.5 ASD to the high current density edge of the test panel. However, in the current density range from about zero to 2.5 ASD, the deposit was dark and non-uniform and exhibited step plate.

On adding $3.4 \times 10^{-3}$ moles per liter (0.4 gram per liter) of 2,5-dihydrothiophene-1,1-dioxide (sulfolene) to the plating solution and repeating the plating test, the resulting nickel-iron deposit was free of the low current density darkness and step plate noted above and exhibited a uniform transition between middle and low current density areas.

Although this invention has been illustrated by reference to specific embodiments, modifications thereof which are clearly within the scope of the invention will be apparent to those skilled in the art.

What is claimed is:

1. A process for the preparation of an electrodeposit which contains; at least one metal selected from the group consisting of nickel and cobalt or; binary or ternary alloys of the metals selected from nickel, iron, and cobalt; which comprises passing current from an anode to a cathode through an aqueous acidic electroplating solution containing at least one member selected from nickel compounds and cobalt compounds and iron compounds providing nickel, cobalt and iron ions for electrodepositing nickel, cobalt, nickel-cobalt alloys, nickel-iron alloys, cobalt-iron alloys or nickel-iron-cobalt alloys; the improvement comprising the presence of $5\times10^{-6}$ moles per liter to 0.5 mole per liter of an unsaturated cyclosulfone exhibiting the following generalized structural formula:

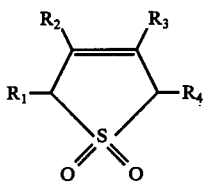

wherein $R_1$, $R_2$, $R_3$ and $R_4$ are independently hydrogen, lower alkyl, or hydroxyl;

for a time period sufficient to form a metal electroplated upon said cathode.

2. The process of claim 1 wherein at least one cyclosulfone is 2,5-Dihydrothiophene-1,1-dioxide (Sulfolene).

3. The process of claim 1 wherein at least one cyclosulfone is 3-Methylsulfolene.

4. The process of claim 1 wherein at least one cyclosulfone is 2,4-Dimethylsulfolene.

5. The process of claim 1 wherein at least one cyclosulfone is 2-Hydroxysulfolene.

6. A composition for the preparation of an electrodeposit which contains; at least one metal selected from the group consisting of nickel and cobalt or; binary or ternary alloys of the metals selected from nickel, iron, and cobalt; which comprises an aqueous acidic electroplating solution containing at least one member selected from nickel compounds and cobalt compounds and iron compounds providing nickel, cobalt and iron ions for electrodepositing nickel, cobalt, nickel-cobalt alloys, nickel-iron alloys, cobalt-iron alloys or nickel-iron-cobalt alloys; the improvement comprising the presence of $5\times10^{-6}$ moles per liter to 0.5 mole per liter of an unsaturated cyclosulfone exhibiting the following generalized structural formula:

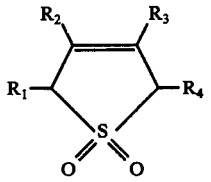

wherein $R_1$, $R_2$, $R_3$ and $R_4$ are independently hydrogen, lower alkyl, or hydroxyl.

7. The composition of claim 6 wherein at least one cyclosulfone is 2,5-Dihydrothiophene-1,1-dioxide (Sulfolene).

8. The composition of claim 6 wherein at least one cyclosulfone is 3-Methylsulfolene.

9. The composition of claim 6 wherein at least one cyclosulfone is 2,4-Dimethylsulfolene.

10. The composition of claim 6 wherein at least one cyclosulfone is 2-Hydroxysulfolene.

* * * * *